US009453699B1

(12) United States Patent
Barnett

(10) Patent No.: US 9,453,699 B1
(45) Date of Patent: Sep. 27, 2016

(54) CROSSBOW WITH RETRACTABLE SUPPORT LEVER

(71) Applicant: Barnett Outdoors, LLC, Tarpon Springs, FL (US)

(72) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 141 days.

(21) Appl. No.: 14/146,785

(22) Filed: Jan. 3, 2014

Related U.S. Application Data

(60) Provisional application No. 61/748,568, filed on Jan. 3, 2013.

(51) Int. Cl.
*F41B 5/14* (2006.01)
*F41C 23/04* (2006.01)
*F41B 5/12* (2006.01)

(52) U.S. Cl.
CPC ..... *F41B 5/123* (2013.01); *F41B 5/1484* (2013.01); *F41C 23/04* (2013.01)

(58) Field of Classification Search
CPC ..... F41C 23/14; F41C 23/00; F41C 23/12; F41C 23/04; F41C 23/22; F41B 5/00; F41B 5/1484
See application file for complete search history.

(56) References Cited

U.S. PATENT DOCUMENTS 46,365 A 2/1865 Kinman
562,487 A 6/1896 Quackenbush
2,098,139 A * 11/1937 Foley et al. ..... 42/106
2,441,487 A 5/1948 Howard
2,763,951 A * 9/1956 Harvey ..... 42/71.01
2,786,461 A 3/1957 Pelsue
3,162,966 A 12/1964 Coss
3,184,877 A 5/1965 Andrews
3,209,481 A 10/1965 Gilbert
3,324,588 A 6/1967 Gilbert
3,968,783 A 7/1976 Pfotenhauer
4,296,566 A 10/1981 Campos
D283,637 S 4/1986 Williams
4,719,897 A 1/1988 Gaudreau
4,735,007 A * 4/1988 Gal ..... 42/72
4,843,749 A 7/1989 Griffith
5,209,215 A * 5/1993 Morrison ..... 124/25
5,215,069 A * 6/1993 Liu ..... 124/25
5,761,842 A * 6/1998 Mantymaa ..... 42/71.02
5,778,588 A * 7/1998 Allen et al. ..... 42/71.02
(Continued)

FOREIGN PATENT DOCUMENTS

WO WO0043724 A1 7/2000

*Primary Examiner* — John E Simms, Jr.
(74) *Attorney, Agent, or Firm* — Jones Walker LLP

(57) ABSTRACT

A compound crossbow including a stock having a forward end and a rearward end. The crossbow includes a bow assembly mounted to the forward end of the stock and a retractable support lever operatively connected to the stock by a pivot point hinge. The retractable support lever is pivotable about the pivot point hinge between a retracted position, in which the retractable support lever is folded against the stock lower portion, and an extended position, in which the retractable support lever extends rearward from the pivot point hinge such that a distal end of the retractable support lever is positioned rearward of the rearward end of the stock. The crossbow may further include a guide configured to house and retain a knife within a receptacle of the stock lower portion.

18 Claims, 13 Drawing Sheets

(56) References Cited

U.S. PATENT DOCUMENTS

| | | | | |
|---|---|---|---|---|
| 6,591,825 | B1 | 7/2003 | Huddleston | |
| 7,677,233 | B2 | 3/2010 | Bednar | |
| 2007/0068501 | A1* | 3/2007 | Bednar | 124/25 |
| 2008/0190004 | A1* | 8/2008 | Filicietti | 42/71.01 |
| 2011/0271944 | A1* | 11/2011 | Haney | F41G 1/467 124/87 |
| 2013/0174463 | A1* | 7/2013 | Hinds | 42/94 |

* cited by examiner

CROSSBOW WITH RETRACTABLE SUPPORT LEVER

CROSS-REFERENCE TO RELATED APPLICATION

This application claims the benefit of and priority to U.S. Provisional Application No. 61/748,568, filed Jan. 3, 2013, which is incorporated herein by reference.

BACKGROUND OF THE INVENTION

Crossbows have been used for centuries. However, crossbows have become very popular for hunting and recreational activities. In general, the crossbow contains a stock, a bow attached to the stock, with the bow containing cables and bow string, and the butt of crossbow. The weight of the crossbow may become a factor when the crossbow is used by an archer. Prior art crossbows are commercially available from Barnett Outdoors, LLC, e.g., the Wild Cat crossbow.

DETAILED DESCRIPTION OF THE PREFERRED EMBODIMENTS

Figure 1:
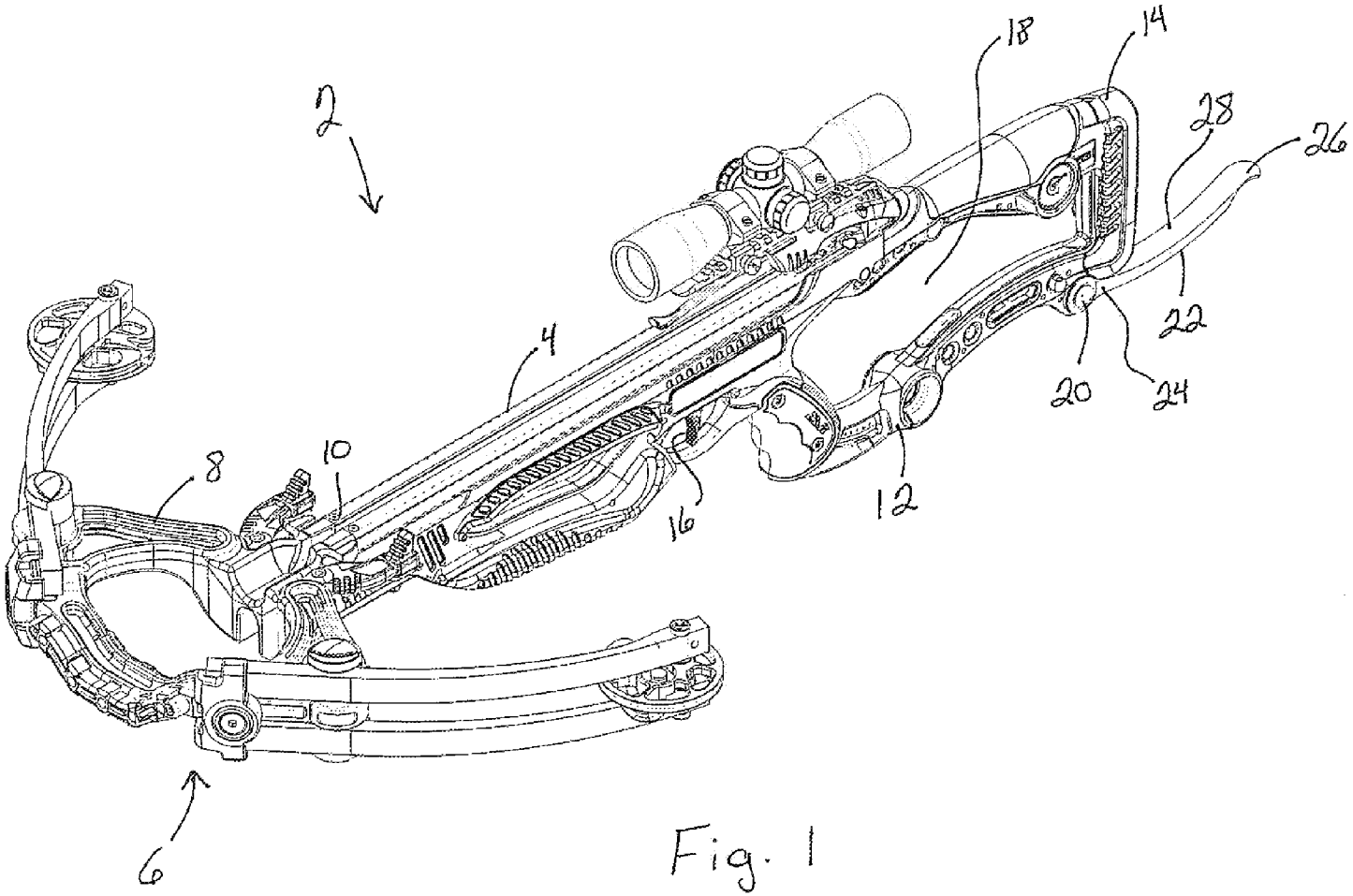
FIG. 1 is a perspective view of a crossbow with a retractable support lever in an extended position.

With reference to FIGS. 1-4, crossbow 2 may include stock 4 and bow assembly 6 operatively attached to riser 8 at forward end 10 of stock 4. Stock 4 may include stock lower portion 12 near rearward end 14 of stock 4. Crossbow 2 may also include trigger mechanism 16 operatively connected to stock 4 between forward end 10 and rearward end 14. Stock 4 may include open area 18 above stock lower portion 12. Alternatively, stock 4 may include no open area above stock lower portion 12.

Stock lower portion 12 may include pivot point hinge 20. Crossbow 2 may further include retractable support lever 22 with proximal end 24 operatively connected to pivot point hinge 20. Retractable support lever 22 may be configured for rotation about pivot point hinge 20 between an extended position shown in FIGS. 1-2 and a retracted position shown in FIGS. 3-4. In the extended position, distal end 26 of retractable support lever 22 may extend beyond rearward end 14 of stock 4. In the retracted position, retractable support lever 22 may fold into or against stock lower portion 12.

Figure 5:
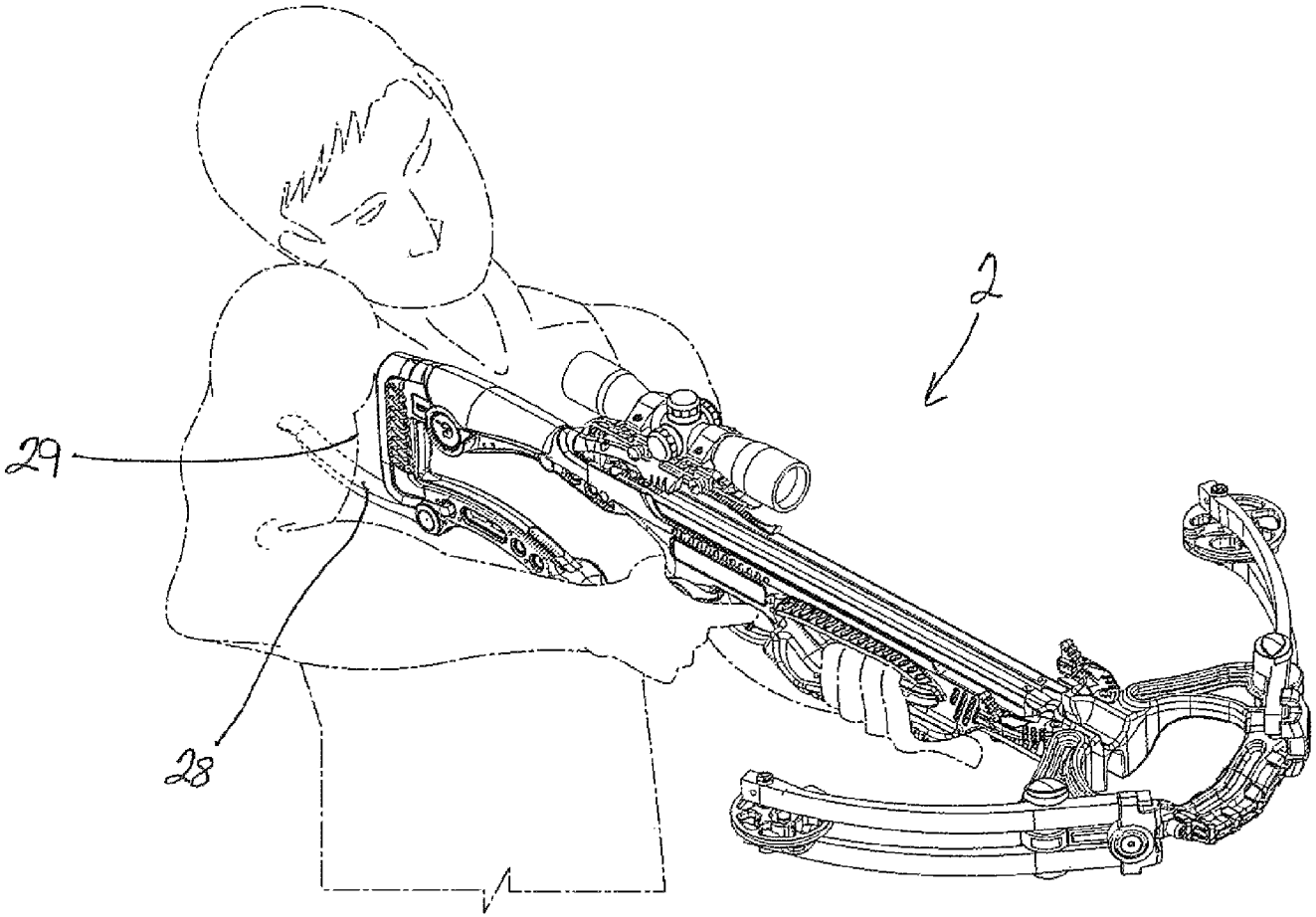
FIG. 5 is a perspective view of the crossbow held in a shooting position by a user.

Retractable support lever 22 may further include curved contour 28 between proximal end 24 and distal end 26. As shown in FIG. 5, curved contour 28 may be configured to fit beneath and cooperate with underarm 29 of a user when crossbow 2 is held in a shooting position with retractable support lever 22 in the extended position. Curved contour 28 of retractable support lever 22 may be configured to match a curved contour of stock lower portion 12 when retractable support lever 22 is in the retracted position.

Retractable support lever 22 may be formed of aluminum and anodized. Alternatively, retractable support lever 22 may be formed of any durable material, such as a composite, metal, or metal alloy. Retractable support lever 22 may have a length in the range of 4-10 inches. Preferably, retractable support lever 22 may have a length in the range of 6-7 inches. In one embodiment, retractable support lever 22 may have a length of approximately 6.75 inches.

Figure 6:
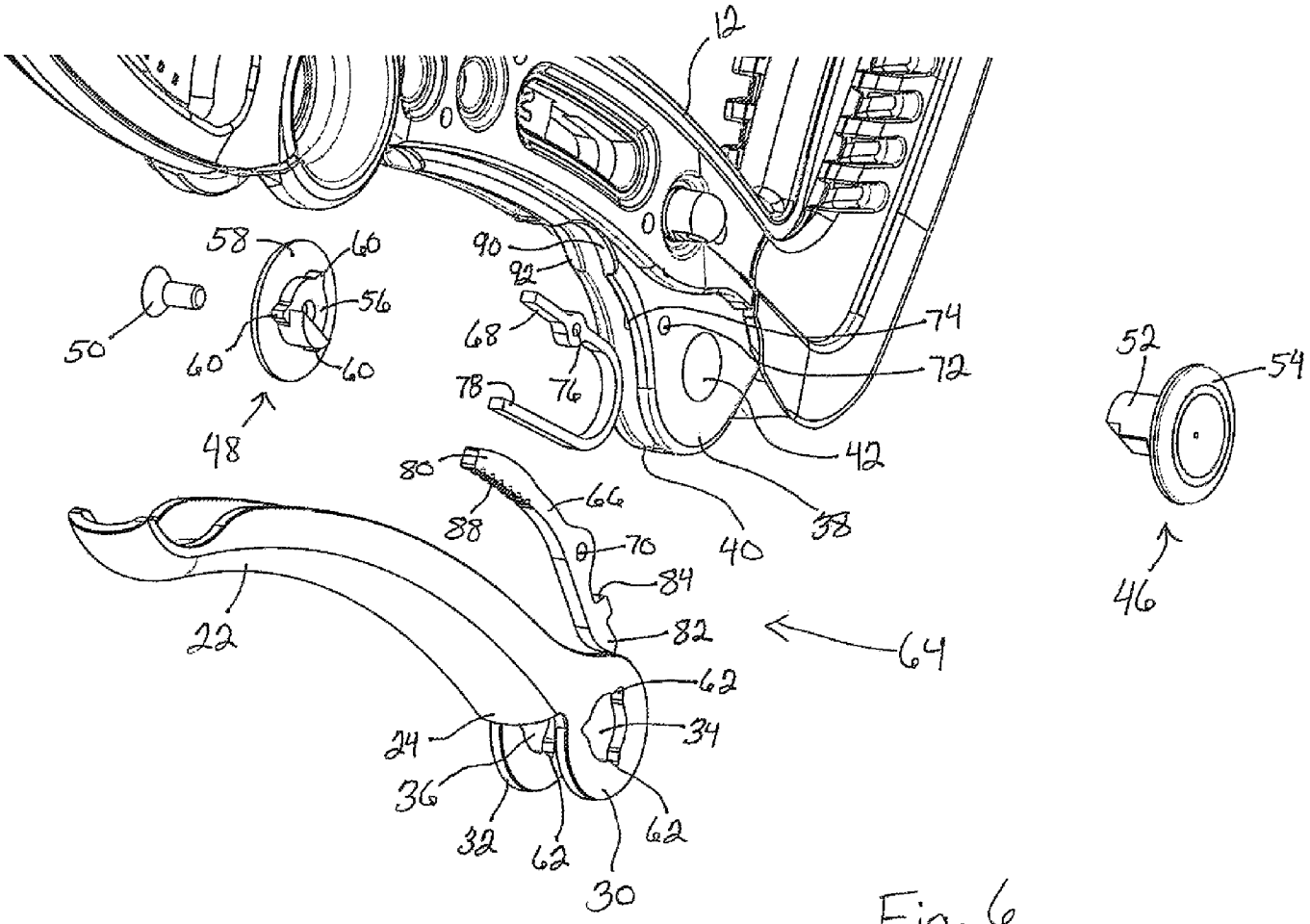
FIG. 6 is an exploded perspective view of the components of a locking mechanism for the retractable support lever.
Figure 7:
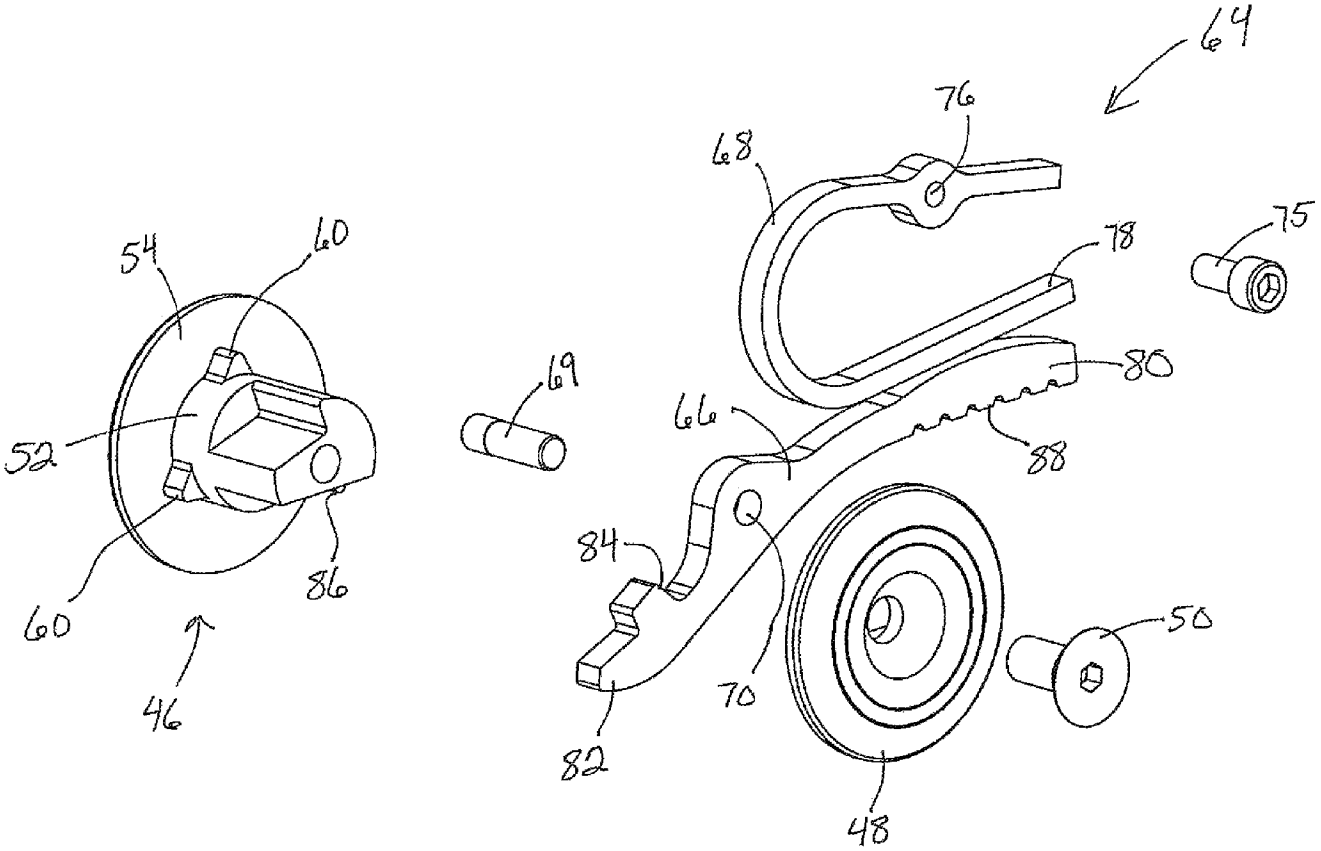
FIG. 7 is another exploded perspective view of the locking mechanism components.

Referring now to FIGS. 6 and 7, retractable support lever 22 may include parallel extensions 30 and 32 at proximal end 24. Extensions 30 and 32 may include apertures 34 and 36, respectively. Stock lower portion 12 may include parallel extensions 38 and 40 having apertures 42 and 44 (not visible in FIG. 6), respectively. Extensions 38 and 40 of stock lower portion 12 may fit between extensions 30 and 32 of retractable support lever 22.

Pivot point hinge 20 may include first hinge member 46, second hinge member 48, and pin 50. First hinge member 46 may include sleeve 52 extending from face member 54. Second hinge member 48 may include sleeve 56 extending from face member 58. Sleeves 52 and 56 may each include an outer profile configured to cooperate with the shape of apertures 34 and 36 of retractable support lever 22 and to cooperate with the shape of apertures 42 and 44 of stock lower portion 12. For example, sleeves 52 and 56 may each include projections 60 shaped to fit within V-shaped portions 62 of apertures 34 and 36 of retractable support lever 22. Sleeves 52 and 56 may also include a portion configured to fit through apertures 42 and 44 of stock lower portion 12. Sleeves 52 and 56 may each include a central bore dimensioned to receive pin 50. When assembled, rotation of retractable support lever 22 about pivot point hinge 20 may rotate first and second hinge members 46 and 48 relative to extensions 38 and 40 of stock lower portion 12.

Crossbow 2 may further include lock assembly 64 for retractable support lever 22. Lock assembly 64 may be configured to lock retractable support lever 22 in the extended position and to snap retractable support lever 22 into the retracted position. Lock assembly 64 may include lock member 66 and spring member 68. Spring member 68 may U-shaped. Alternatively, spring member 68 may be any other type of spring capable of applying force to lock member 66.

When assembled, lock member 66 may be attached to extension 38 and 40 of stock lower portion 12 with pin 69 secured through aperture 70 of lock member 66 and apertures 72 and 74 of extensions 38 and 40. In this way, lock member 66 may be pivotable about aperture 70. Alternatively, lock member 66 may be secured to extensions 38 and 40 with a bolt, screw, or any other mechanism suitable for providing a pivoting connection. Spring member 68 may be attached within an internal section of stock lower portion 12 with pin 75 secured through aperture 76 of spring member 68. Alternatively, spring member 68 may be secured to the internal section of stock lower portion 12 with a bolt, screw, or any other suitable mechanism. Lower leg 78 of spring member 68 may engage forward end 80 of lock member 66.

Figure 8:
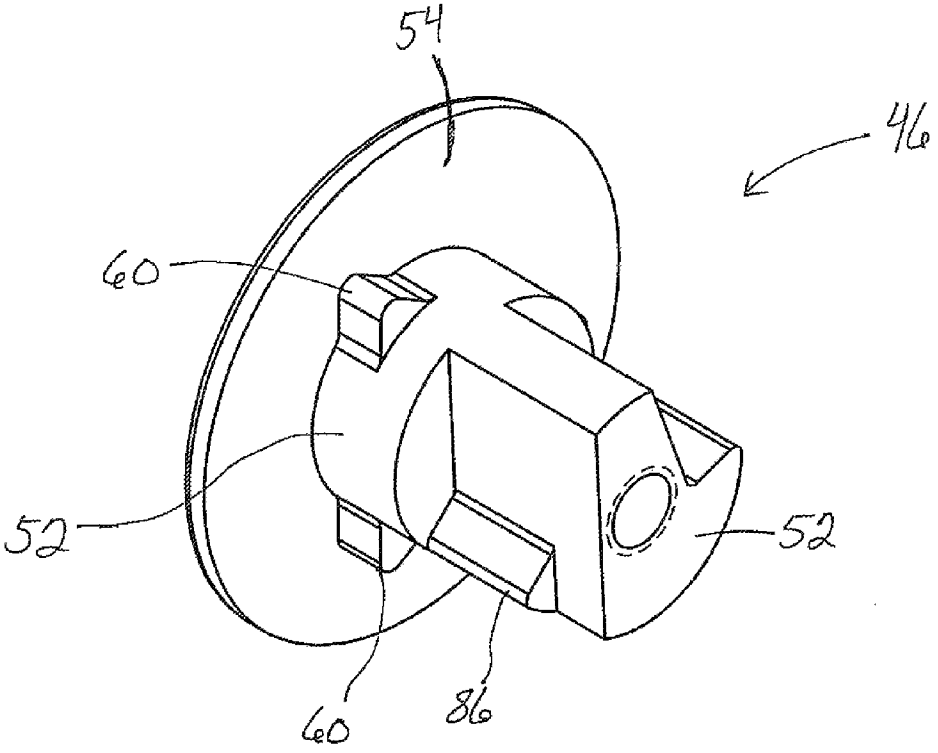
FIG. 8 is a perspective view of a first hinge member.

Lower leg 78 of spring member 68 may apply a downward force on forward end 80 of lock member 66, thereby pivoting rearward end 82 of lock member 66 upward placing shoulder 84 of lock member 66 in position to engage shoulder 86 of sleeve 52 (also shown in FIG. 8) when retractable support lever 22 is rotated into the extended position. In this way, lock member 66 locks retractable support lever 22 in the extended position. To unlock retractable support lever 22, an upward force may be applied to grip 88 of lock member 66 in order to pivot forward end 80 upward and rearward end 82 downward, thereby disengaging shoulders 84 and 86 and allowing retractable support lever 22 to be rotated out of the extended position and into the retracted position. Extensions 38 and 40 of stock lower portion 12 may each include recess 90 and 92 to allow a user to press grip 88 of lock member 66 upwardly between extensions 38 and 40.

Placing retractable support lever 22 in the retracted position may provide for ease of transportation of crossbow 2. In the retracted position, curved contour 28 of retractable support lever 22 may fit into the curvature of stock lower portion 12. Lock assembly 64 may retain retractable support lever 22 in the retracted position such that a user must apply a downward force on retractable support lever 22 to rotate it out of the retracted position.

When counter balance support is desired, the user may rotate retractable support lever 22 out of the retracted position and into the extended position. Lock assembly 64 may lock retractable support lever 22 in the extended position. Retractable support lever 22 may be placed under the arm of the user such that curved contour 28 engages the user's under arm in order to counter balance the weight of crossbow 2 when held by the user in a shooting position. In order to return retractable support lever 22 to the retracted position, a user may apply an upward force on grip 88 of lock member 66 in order to allow retractable support lever 22 to be rotated out of the extended position.

Figure 9:
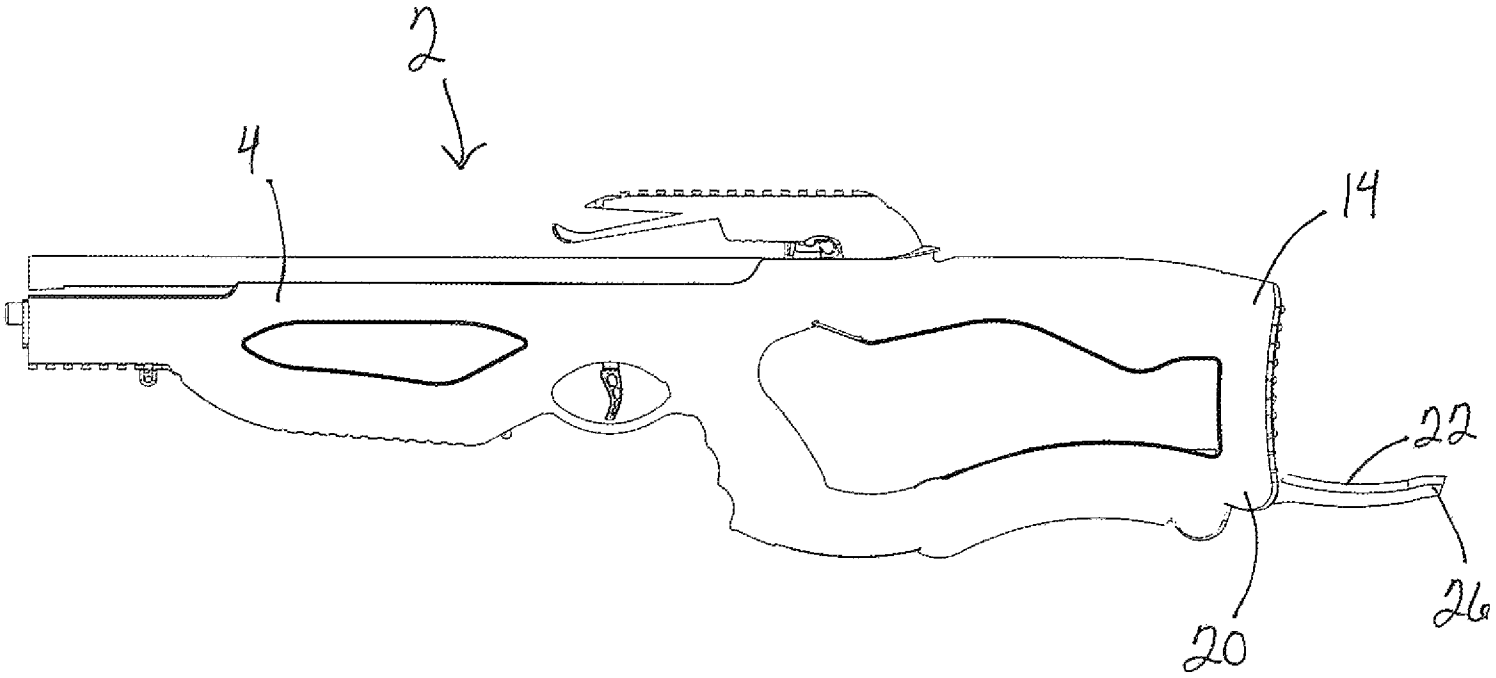
FIG. 9 is a side view of the crossbow with an alternate embodiment of the retractable support lever in an extended position
Figure 10:
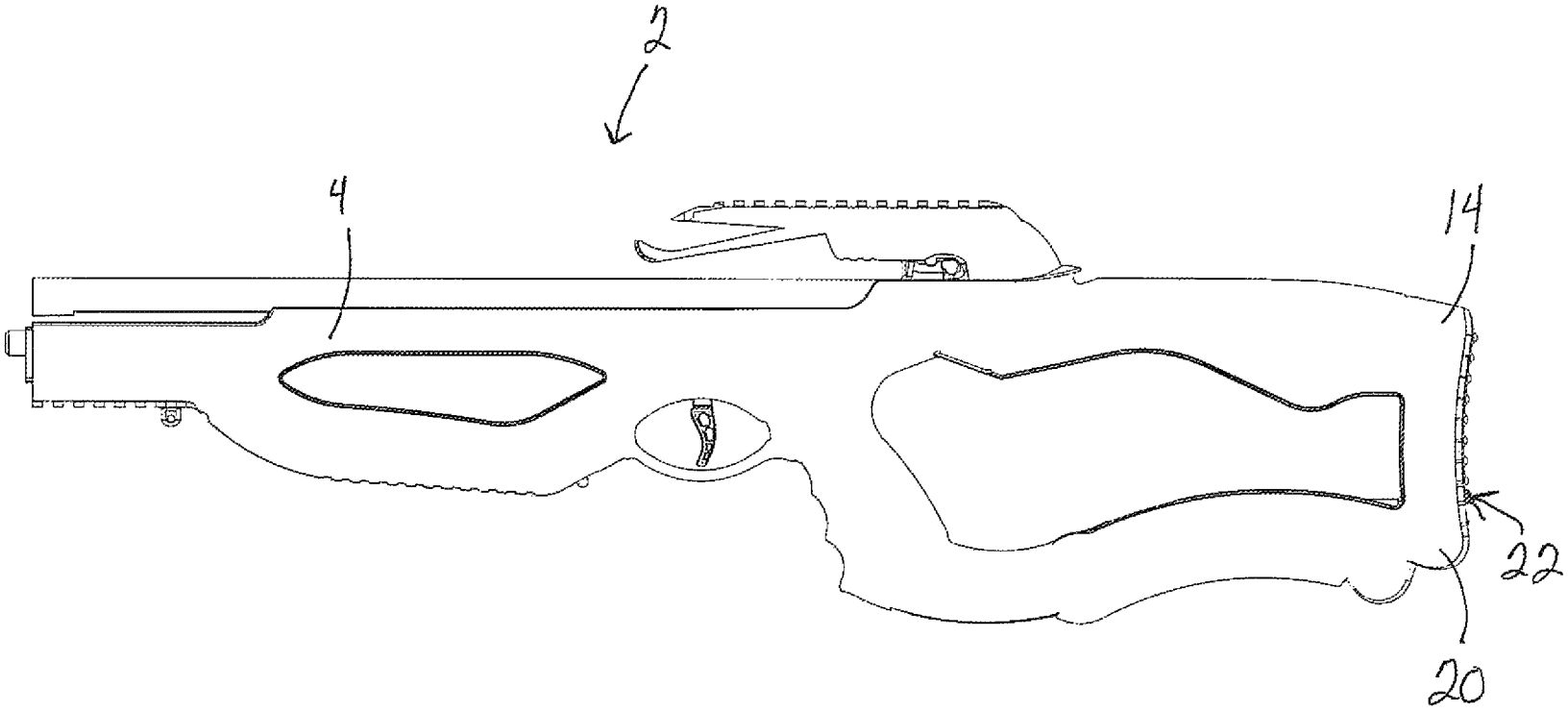
FIG. 10 is a side view of the crossbow with the retractable support lever of FIG. 9 in a retracted position.

FIGS. 9 and 10 illustrate an alternate embodiment of crossbow 2 in which retractable support lever 22 is operatively connected to pivot point hinge 20 on rearward end 14 of stock 4. In this embodiment, retractable support lever 22 may be configured for rotation about pivot point hinge 20 between an extended position shown in FIG. 9 and a retracted position shown in FIG. 10. In the extended position, distal end 26 of retractable support lever 22 may extend beyond rearward end 14 of stock 4. In the retracted position, retractable support lever 22 may fold into or against rearward end 14 of stock 4.

Figure 2:
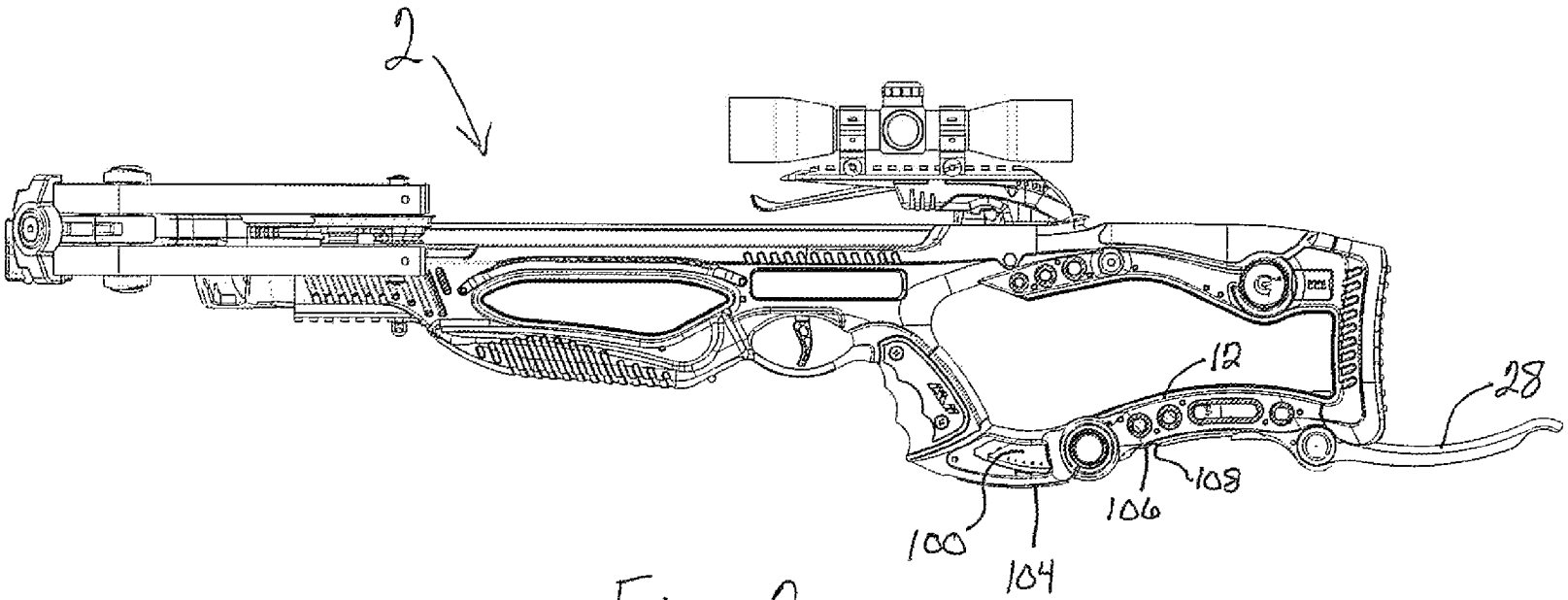
FIG. 2 is a side view of the crossbow with the retractable support lever in the extended position.
Figure 3:
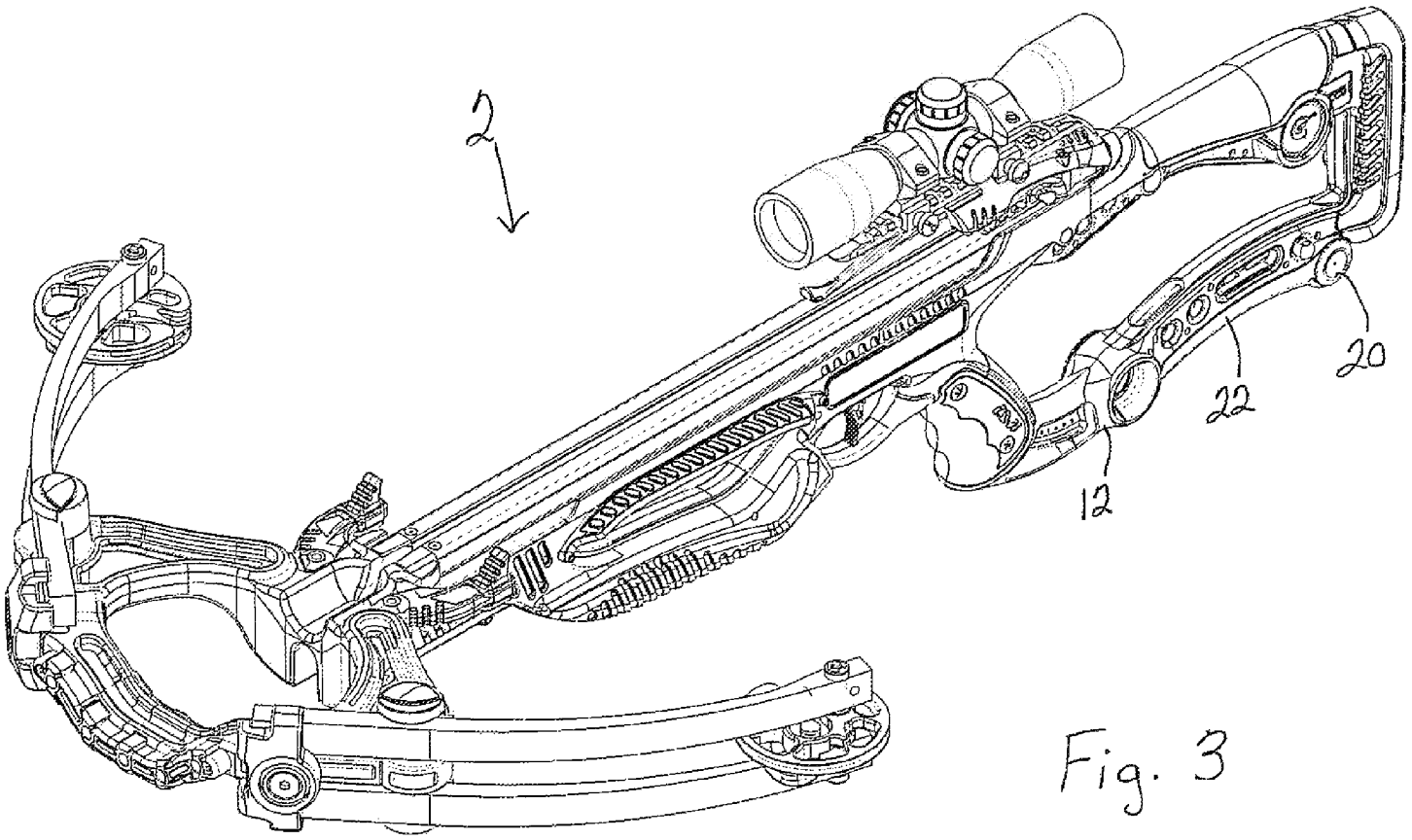
FIG. 3 is a perspective view of the crossbow with the retractable support lever in a retracted position.
Figure 4:
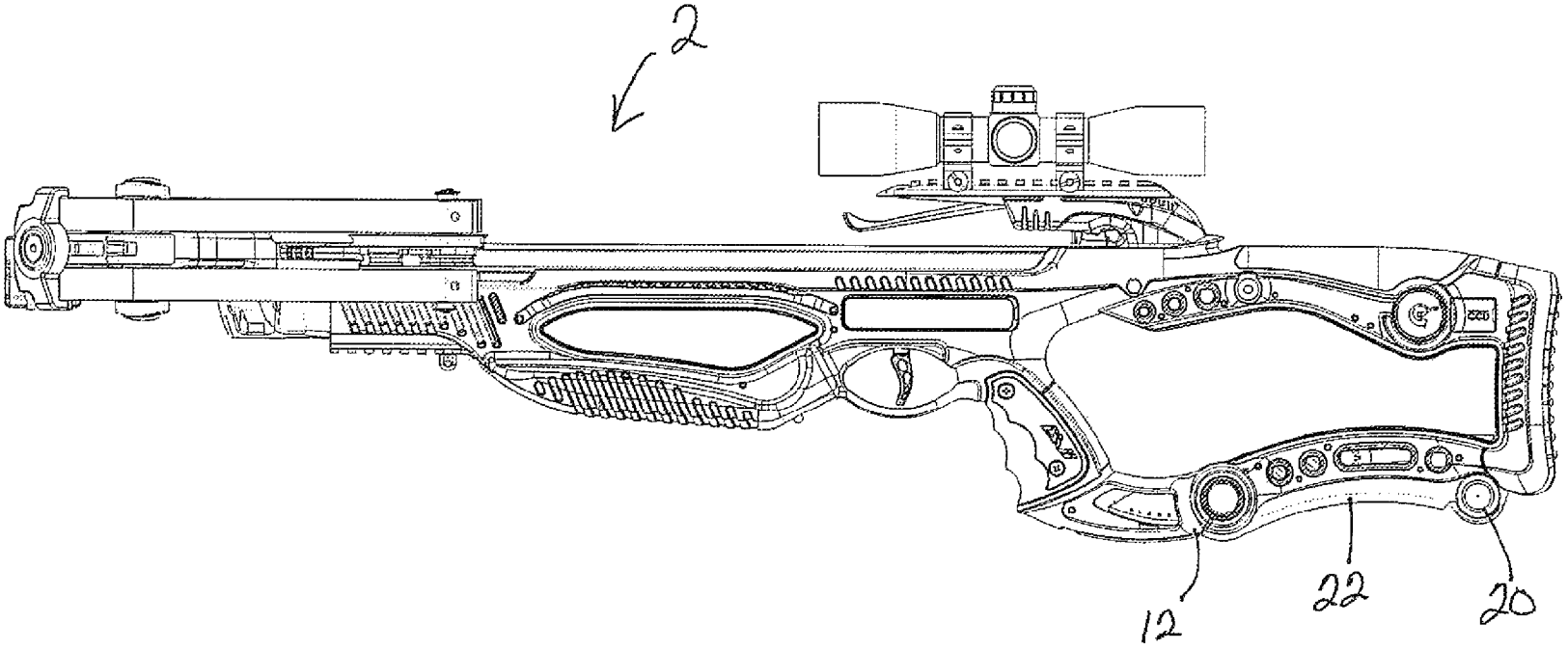
FIG. 4 is a side view of the crossbow with the retractable support lever in the retracted position.
Figure 11:
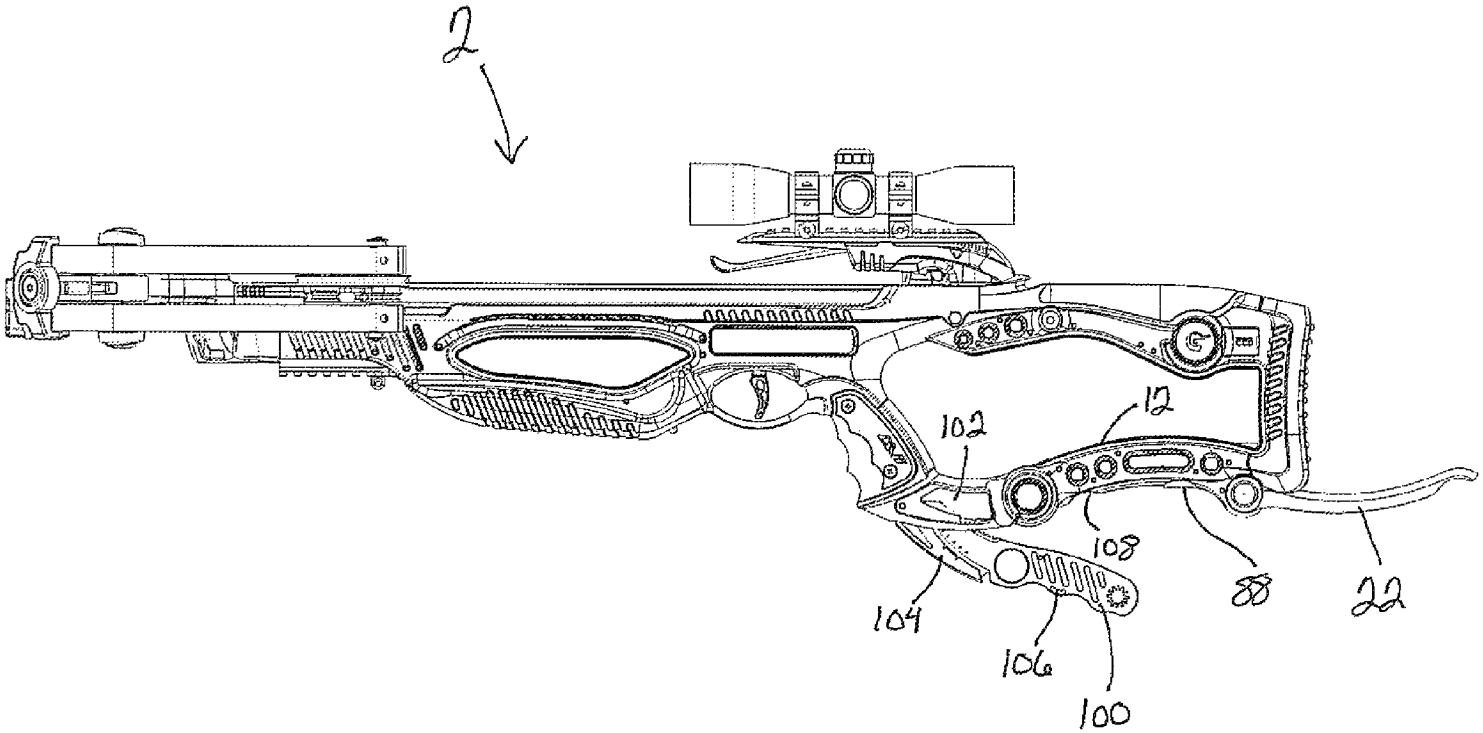
FIG. 11 is a side view of the crossbow with the retractable support lever in the extended position and a guide for a detachable knife in an extended position.
Figure 12:
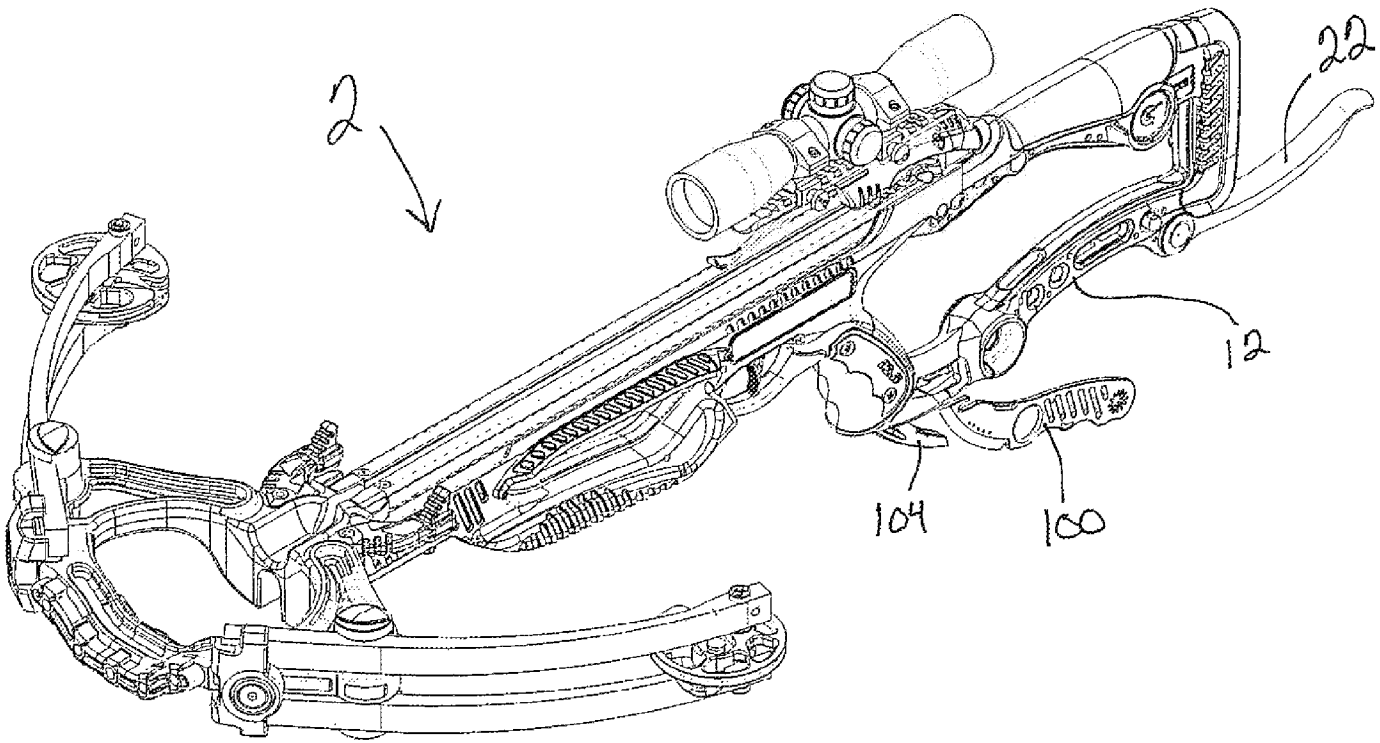
FIG. 12 is a perspective view of the crossbow having the detachable knife separated from the crossbow.
Figure 13:
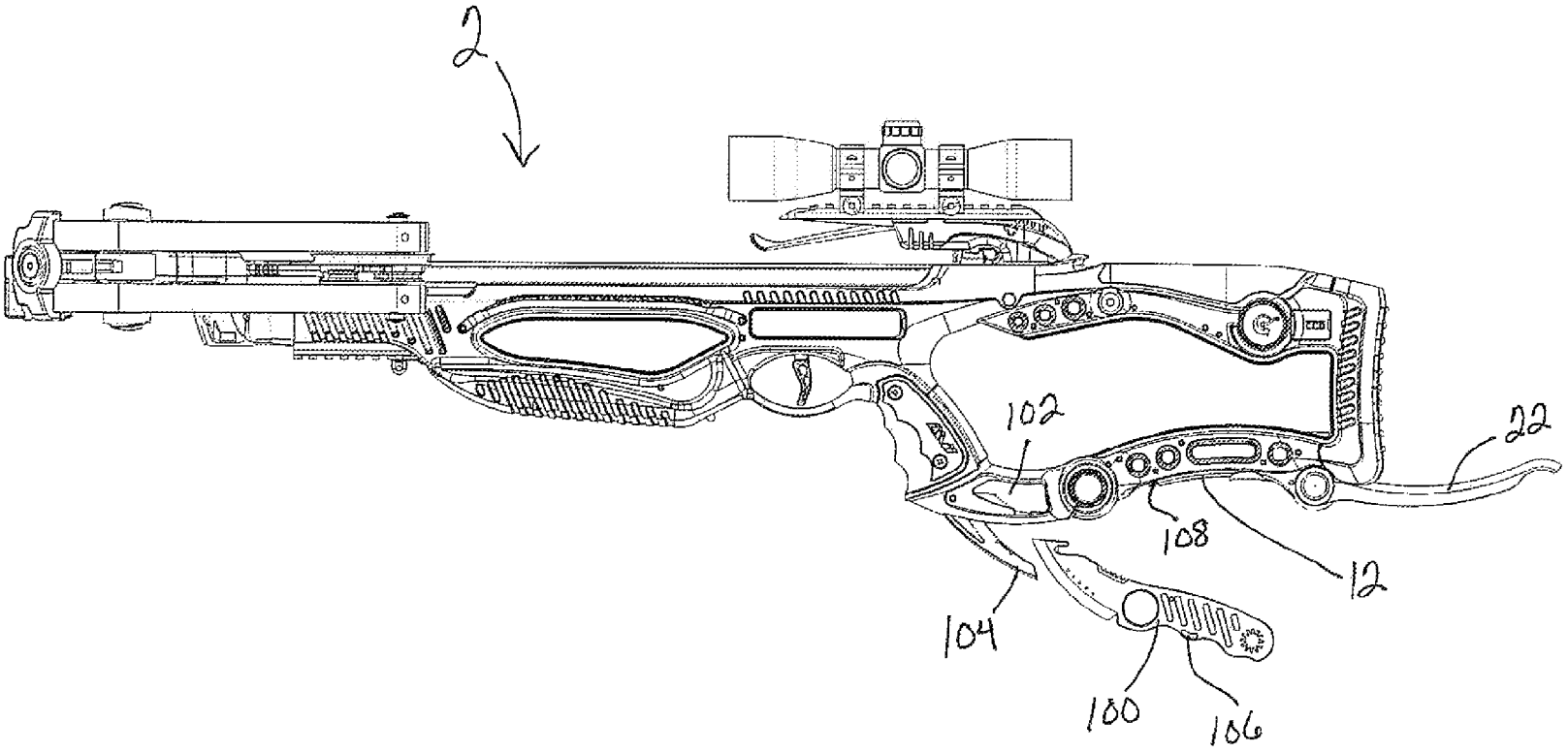
FIG. 13 is a side view of the crossbow having the detachable knife separated from the crossbow.

With reference now to FIGS. 11-13, crossbow 2 may further include detachable knife 100. Detachable knife 100 may be housed within receptacle 102 of stock lower portion 12. Receptacle 102 may be formed of a polymer with a magnet overmold in order to improve the retention of detachable knife 100. Receptacle 102 may be formed by injection molding, and may have a length in the range of 1-5 inches. Preferably, receptacle 102 may have a length of approximately 3 inches. Guide 104 may hold detachable knife 100 in receptacle 102. With retractable support lever 22 in the extended position as shown in FIG. 2, detachable knife 100 may be accessed by pulling downward on grip 106 of detachable knife 100 protruding past recess 108 of stock lower portion 12, which may pull guide 104 from a retracted position shown in FIG. 2 into an extended position shown in FIGS. 11-13. With guide 104 in the extended position, detachable knife 100 may be separated from crossbow 2 as shown in FIGS. 12-13. Retractable support lever 22 in the retracted position (shown in FIGS. 3-4) may cooperate with guide 104 to retain detachable knife 100 within receptacle 102. Guide 104 may include a curved contour that cooperates with a curved portion of stock lower portion 12.

An aspect of one embodiment is that retractable support lever 22 can be locked into either the retracted position or the extended position. Another aspect of one embodiment is that in the retracted position, retractable support lever 22 is seamless and hidden away.

Although the present invention has been described in considerable detail with reference to certain preferred versions thereof, other versions are possible. Therefore, the spirit and scope of the appended claims should not be limited to the description of the preferred versions contained herein.

I claim:

1. A compound crossbow comprising:

a stock having a forward end and a rearward end, the rearward end of the stock terminating at a butt;

a bow assembly mounted to the forward end of the stock; and a retractable support lever pivotally connected to a lower portion of the stock by a pivot point hinge and being pivotable about the pivot point hinge between a retracted position and an extended position, wherein in the retracted position the retractable support lever is folded against the stock, and wherein in the extended position the retractable support lever extends rearward from the pivot point hinge such that a distal end of the retractable support lever is positioned rearward of the rearward end of the stock;

wherein the retractable support lever includes a curved contour dimensioned to engage an underarm of the user when the retractable support lever is in the extended position and to provide a counter-balance support of a weight of the crossbow when the crossbow is held in the shooting position;

wherein in the extended position the retractable support lever is spatially oriented perpendicular to the butt of the rearward end of the crossbow stock; and wherein in the extended position the retractable support lever extends from a lower end of the butt of the stock such that the butt of the stock rests on a shoulder of a user and the retractable support lever simultaneously engages the underarm of the user when held in a shooting position.

2. The compound crossbow of claim 1, wherein the curved contour matches a curved profile of the stock.

3. The compound crossbow of claim 1, further comprising a lock assembly configured to lock the retractable support lever in the extended position.

4. The compound crossbow of claim 3, wherein the lock assembly includes a lock member having a grip portion, wherein rotation of the grip portion allows the retractable support lever to be rotated out of the extended position.

5. The compound crossbow of claim 4, wherein the lock member is spring loaded.

6. The compound crossbow of claim 4, wherein the lock member includes a U-shaped spring affixed within the stock.

7. The compound crossbow of claim 4, wherein the stock includes a recess to provide access to the grip portion of the lock member when the retractable support lever in the extended position.

8. The compound crossbow of claim 1, wherein in the retracted position the retractable support lever extends forward from the pivot point hinge.

9. The compound crossbow of claim 1, wherein the retractable support lever is pivotally connected to the rearward end of the stock by the pivot point hinge, and wherein in the retracted position the retractable support lever extends upward from the pivot point hinge.

10. The compound crossbow of claim 1 further comprising:

a guide pivotally connected to the stock and being pivotable between a retracted position and an extended position, wherein in the retracted position the guide is configured to retain a knife within a receptacle of the stock, and wherein in the extended position the guide is configured to allow access to the receptacle for inserting or removing a knife.

11. The compound crossbow of claim 10, further comprising a removable knife dimensioned to fit completely within the receptacle of the stock.

12. The compound crossbow of claim 11, wherein the stock includes a recess to provide access to a grip portion of the removable knife disposed within the receptacle of the stock in order to rotate the guide from the retracted position to the extended position.

13. The compound crossbow of claim 1 wherein the retractable support lever has a length in the range of 4 to 10 inches.

14. The compound crossbow of claim 13 wherein the retractable support lever has a length in the range of 6 to 7 inches.

15. The compound crossbow of claim 14 wherein the retractable support lever has a length of about 6.75 inches.

16. The compound crossbow of claim 1 wherein the retractable support lever is made of a composite, a metal or a metal alloy.

17. The compound crossbow of claim 16 wherein the retractable support lever is made of aluminum.

18. The compound crossbow of claim 17 wherein the aluminum retractable support lever is anodized.

* * * * *